US009272393B2

(12) United States Patent
Ali et al.

(10) Patent No.: US 9,272,393 B2
(45) Date of Patent: Mar. 1, 2016

(54) FOAMED RIGID BOTTOM SANDING BLOCK

(75) Inventors: Terry Ali, Fairborn, OH (US); Christopher Ali, Beavercreek, OH (US); Frank Ali, Xenia, OH (US); Wayne Carl Leblanc, Enon, OH (US)

(73) Assignee: ALI Industries, Inc., Fairborn, OH (US)

( * ) Notice: Subject to any disclaimer, the term of this patent is extended or adjusted under 35 U.S.C. 154(b) by 772 days.

(21) Appl. No.: 13/105,869

(22) Filed: May 11, 2011

(65) Prior Publication Data

US 2012/0289135 A1 Nov. 15, 2012

(51) Int. Cl.

| | |
|---|---|
| ***B24D 15/04*** | (2006.01) |
| ***B24D 18/00*** | (2006.01) |
| ***B24B 23/00*** | (2006.01) |
| ***B24D 15/02*** | (2006.01) |

(52) U.S. Cl.

CPC ..... *B24D 18/0009* (2013.01); *B24B 23/00* (2013.01); *B24D 15/023* (2013.01); *B24D 15/04* (2013.01)

(58) Field of Classification Search

CPC ..... B24B 23/00; B24D 15/023; B24D 15/04
USPC ..... 451/344, 523, 524, 533, 538, 539
See application file for complete search history.

(56) References Cited

U.S. PATENT DOCUMENTS

| | | | | |
|---|---|---|---|---|
| 4,221,084 | A | 9/1980 | Frantzen | |
| 4,484,419 | A | 11/1984 | Freerks | |
| 4,551,290 | A * | 11/1985 | Mizell | 264/46.6 |
| 4,922,665 | A | 5/1990 | Wanatowicz | |
| 5,054,248 | A | 10/1991 | Thayer | |
| 5,313,746 | A | 5/1994 | Zarriello | |
| 5,662,519 | A * | 9/1997 | Arnold | 451/525 |
| 5,902,176 | A | 5/1999 | Chen | |
| 6,227,959 | B1 * | 5/2001 | Beaudry | 451/526 |
| 6,267,658 | B1 * | 7/2001 | Ali et al. | 451/523 |
| 6,439,988 | B1 * | 8/2002 | Long et al. | 451/495 |
| 6,616,519 | B2 | 9/2003 | Mansfield | |
| 6,688,958 | B1 * | 2/2004 | Jones et al. | 451/557 |
| 7,186,174 | B1 | 3/2007 | Arnold | |
| 7,267,609 | B2 * | 9/2007 | Hackett | 451/527 |
| 7,364,500 | B2 * | 4/2008 | Brown | 451/523 |
| D577,561 | S | 9/2008 | Ali | |
| D587,089 | S | 2/2009 | Ali | |
| D603,678 | S | 11/2009 | Ali | |
| D607,297 | S | 1/2010 | Ali | |
| 7,998,378 | B2 * | 8/2011 | Ali et al. | 264/46.4 |
| 2002/0069715 | A1 | 6/2002 | Genco | |

* cited by examiner

*Primary Examiner* — Eileen Morgan

(74) *Attorney, Agent, or Firm* — R. William Graham

(57) ABSTRACT

A foamed rigid bottom sanding block includes a sanding block formed of polyfoam material having a bottom portion with an integrally formed rigid member made of a material to lend weight as well as rigidity to said bottom portion, said rigid member nearly spanning a length and a width of said bottom portion and which encased within said polyfoam material, an upper portion of said sanding block having a handle which protrudes from said bottom portion and is made of said polyfoam material. A method and sanding block formed by the method are included.

8 Claims, 5 Drawing Sheets

FOAMED RIGID BOTTOM SANDING BLOCK

BACKGROUND OF THE INVENTION

1. Field of the Invention

The invention relates generally to the field of sanding devices. More particularly, but not way of limitation, the present invention relates to improvements in sanding blocks.

2. Related Art

Sanding pads and blocks have been described in many different forms. A recent type of sanding block is made expanded foam material having one or more abrasive surfaces. In one case, the abrasive surface is formed on one or more elongated sides of the block and is known in the art as having a feature of deformability so that the pressure applied can be varied to change the amount of sanding performed.

Other sanding blocks are generally integrally formed of rubber and typically include a first member having an intermediate portion and a pair of ends wherein a top surface of the first member is configured to be hand held and a bottom surface of each of the ends has retention surfaces therein and a second member having an intermediate portion and a pair of ends wherein a top surface of the first member is configured to be hand held and a bottom surface of each of the ends has retention surfaces therein and a second member having an intermediate portion connected to the intermediate portion of the first member and a pair of ends wherein a top surface of each end of the second member has a plurality of nails complimentary formed to respectively seat in one of the retention open surfaces. The respective first ends must be pried apart such that the nails are removed from the retention surfaces so that an end of a piece of sandpaper to hold the same in place. The second ends are likewise manipulated to retain the other end of the sandpaper.

Such sanding blocks have not, however, evolved to meet needs of the user. For instance, it is desirable to minimize fatigue to the user while maintaining the effectiveness of the sanding block. Such sanding blocks are presently formed with a smooth surface. Also, the rubber material employed in these blocks is relatively rigid, dense and heavy and difficult for the user to pry apart. This is particularly true for woman which are increasingly entering into the do-it-yourself market. Also, women find it difficult to use the present sanding block without breaking their finger nails.

The inventor of the instant invention has attempted to provide improvements in the field through the making of a polyurethane foam sanding block. While this did minimize fatigue to the user as well as provide a softer feel, these sanders like conventional rubber blocks did not provide a consistent flat surface when pressure was exerted on the same during sanding. For example, when applying pressure on the sander, these sanders bend creating uneven wear on the sanded surface.

There continues to be a need for an improved sanding block. The present invention overcomes these deficiencies of present holders of sanding blocks.

BRIEF SUMMARY OF THE INVENTION

It is an object of the invention to provide an ergonomically improved sanding block.

It is another object of the invention to enhance the ease of use of a sanding block while improving effectiveness of the same.

It is another object to improve the method of making a sanding block.

Another object is to provide a sanding block made from the method as described.

Accordingly, one aspect of the invention is directed to a foamed rigid bottom sanding block. The polyfoam sanding block includes rigid bottom sanding block includes a bottom portion which includes an integrally formed rigid member which can preferably be made of a metal material to lend weight as well as rigidity to a bottom sanding surface of the sanding block. The rigid member nearly spans the length and width of the bottom surface as it is preferably entirely encased within the polyfoam block. Further, the rigid member can preferably be uniformly spaced from the bottom surface. By way of illustration, the rigid member is spaced about an ⅛th inch from the bottom sanding surface.

An upper portion of the sanding block includes a handle which protrudes, preferably from the bottom portion and is made of the polyfoam material. By virtue of a formation process, the polyfoam material between the rigid member and bottom sanding surface is generally more dense than the polyfoam material in the handle.

A hook and loop member can preferably be integrally connected as part of the bottom sanding surface during the block formation. In this regard, the hook and loop member is held in spaced relation to the rigid member during expanding and curing phases of the polyfoam material.

The handle can generally be of a shape which conforms to the palm of a user's hand and for ease of comfort to the user. The handle is ergonomically designed, being symmetrically oriented along a longitudinal axis which generally aligns with a central axis of the block. A back end of the handle is larger than a front end such that a downward slope exists from the back end to the front end and can be formed in a manner as seen in FIG. 1, for example.

The shape of the handle and weight and rigidity of the rigid member and the orientation of the handle are designed such that the sanding block and the user can interact most efficiently and safely to provide an improved hand sander. The invention reduces less fatigue to the person doing the sanding and the sanding operation is performed in a more consistent and uniform manner to provide a smoother finish.

Another aspect of the invention is directed to forming a sanding block of the invention. The method includes the steps of providing a first mold part having a first part forming surface defined by a first perimeter and a second mold part having a second part forming surface defined by a second perimeter which when the first and second perimeters are disposed adjacent one another with the first and second part forming surfaces facing one another there is defined a block forming inner surface having a cavity. The rigid member is suspended and maintained in the cavity adjacent but not touching the block forming inner surface. A polyfoam liquid material is then delivered into cavity and allowing the polyfoam material to expand about the rigid member in a manner to enclose the rigid member substantially within the polyfoam material.

In a preferred embodiment, the rigid member includes a predetermined number of openings which are of a predetermined size and spatially positioned across its surface as a function of flow and expansion characteristics of the polyfoam material. Preferably, the polyfoam liquid is introduced onto the rigid member between a region which forms a bottom surface and is permitted to flow through the openings into the remainder of the cavity which forms an upper surface of the sanding block. The method further includes disposing a hook and loop member adjacent the first mold part such that the polyfoam material is introduced between the rigid member and the hook and loop member, and the hook and loop member is maintained in fixed position relative to the rigid member during curing of the polyfoam material.

Other objects and advantages will be readily apparent to those skilled in the art upon reviewing the drawings and the detailed description which follows:

DETAILED DESCRIPTION OF THE INVENTION

Figure 1:
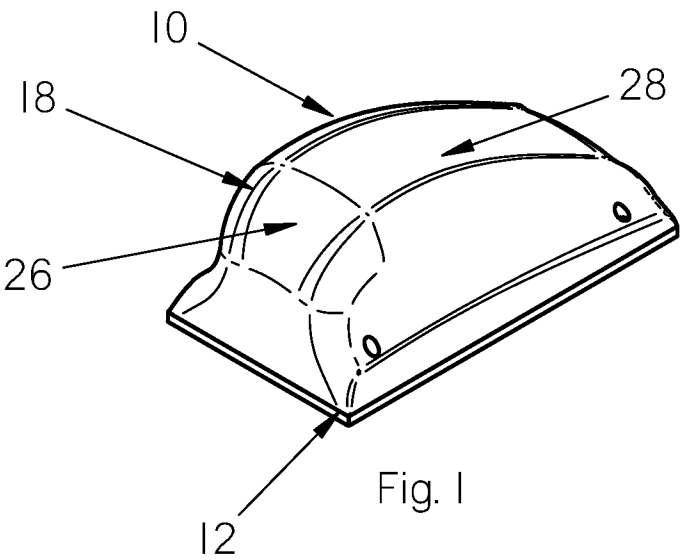
FIG. 1 is a perspective view of a sanding block of the present invention.
Figure 5:
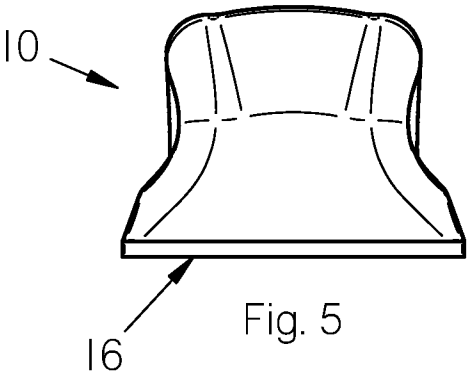
FIG. 5 is a front end view of the sanding block of the present invention.
Figure 2:
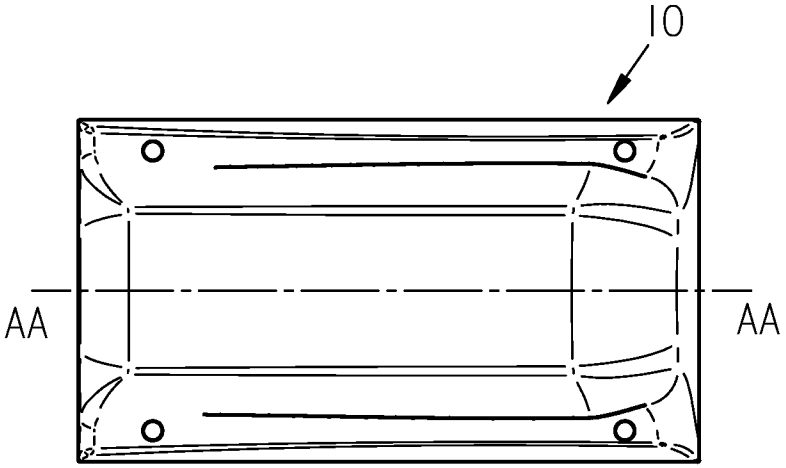
FIG. 2 is top view of the sanding block of the present invention.
Figure 4:
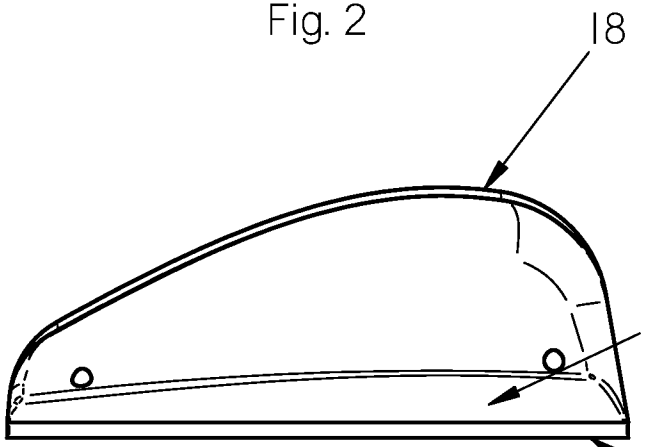
FIG. 4 is a side view of the sanding block of the present invention of which the other side is a mirror image.
Figure 11:
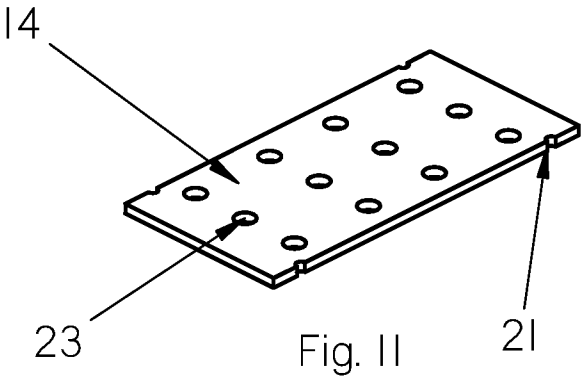
FIG. 11 is a perspective view of a component of the instant invention.
Figure 3:
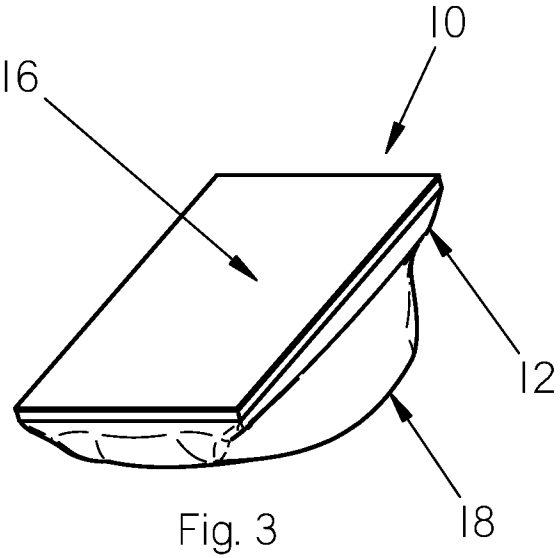
FIG. 3 is bottom perspective view of the sanding block of the present invention.
Figure 18:
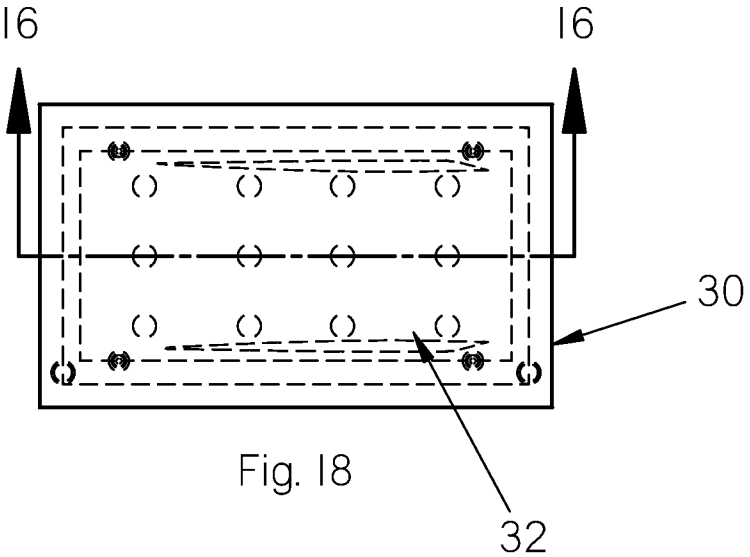
FIG. 18 is a top view of a mold of the invention.

Referring now to the drawings shown in FIGS. 1-17, the sanding block of the invention is generally referred to by the numeral 10. The term "block" used herein is contemplated to include sanding implements having various geometric configurations although the instant invention provides one herewith.

The foamed rigid bottom sanding block 10 includes a bottom portion 12 which includes an integrally formed rigid member 14 which can preferably be of a relatively substantial thickness, e.g., 1/16-1/8th inch, made of a metal material to lend weight as well as rigidity to a bottom sanding surface 16 of the sanding block 10. The rigid member 14 preferably nearly spans the length and width of the bottom sanding surface 16 being slightly less in width and length as it is preferably entirely encased within the polyfoam block 10. In this way, there is prevented delamination between the parts.

Further, the rigid member 14 can preferably be uniformly spaced from the bottom sanding surface 16. By way of illustration, the rigid member 14 is preferably spaced up to about 0.25 inch (more preferably about 1/8$^{th}$ inch) from the bottom sanding surface 16 to provide a sufficient coverage to preclude delamination. The rigid member 14 can preferably be made of a metal to lend the desired rigidity and density, however, other materials or combinations of plastic, metal or wood are contemplated to accomplish the weight and rigidity which is desired in the bottom portion 12.

An upper portion 18 of the sanding block includes a handle which protrudes preferably from the bottom portion 12 and is also formed from the polyfoam material. The polyfoam material is one in which two reactive liquid components, a polyol and an isocyanate, for example are metered, blended together, and introduced into a closed mold at low pressure. By virtue of the formation process as will be discussed hereinafter, the polyfoam material in region 20 between the rigid member 14 and bottom sanding surface 16 is generally more dense than the polyfoam material region 22 forming the handle.

A hook and loop member 24 can preferably be integrally connected as part of the bottom sanding surface 16 during the formation of the sanding block 10. In this regard, the hook and loop member 24 is held in spaced relation to the rigid member 14 during expanding and curing phases of the polyfoam material.

The handle or upper portion 18 can generally be of a shape which conforms to the palm of a user's hand and for ease of comfort to the user. The handle 18 is ergonomically designed, being symmetrically oriented along a longitudinal axis which generally aligns with a central axis A of the block 10. A back end 26 of the handle 18 is larger than a front end 28 such that a downward slope exists from the back end 26 to the front end 28 and can be formed in a manner as seen in FIG. 1, for example.

The shape of the handle 18, weight and rigidity of the rigid member 14 and the orientation of the handle 18 are designed such that the sanding block 10 and the user can interact most efficiently and safely to provide an improved hand sander. The construction of the sanding block 10 reduces less fatigue to the person doing the sanding and the sanding operation is performed in a more consistent and uniform manner.

Another aspect of the invention is directed to forming a sanding block 10 of the invention. The method includes the steps of providing a first mold part 30 having a first part forming surface 32 defined by a first perimeter 34 and a second mold part 40 having a second part forming surface 42 defined by a second perimeter 44 which when the first and second perimeters (34 and 44) are disposed adjacent one another with the first and second part forming surfaces (32 and 42) facing one another there is defined a cavity 50 having an inner surface 52 configured to form an outer surface of a sanding block 10 which includes a bottom surface 16. The rigid member 14 is suspended and maintained in the cavity 50 by virtue of locating pins 46 which include a collar 48 upon which locating surfaces 21 are seated to place the rigid member adjacent but not touching the inner surface 52.

Figure 15:
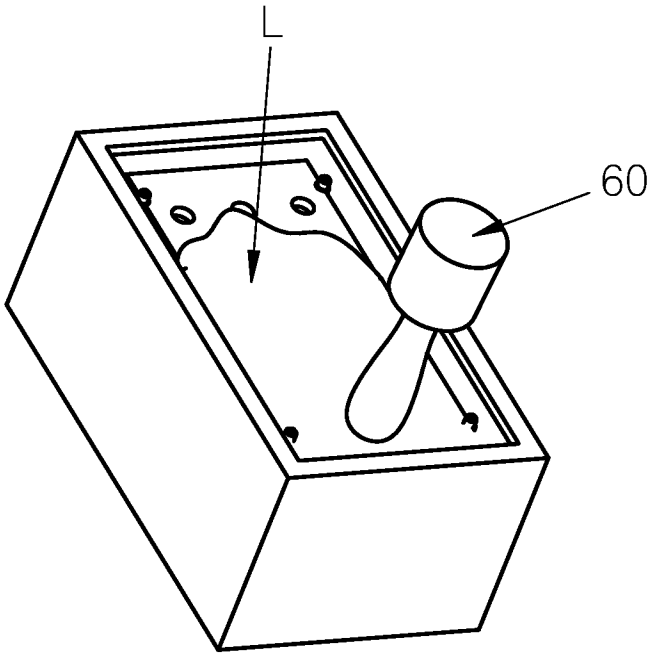
FIG. 15 is a top perspective view illustrating the introduction of polyfoam liquid phase.
Figure 14:
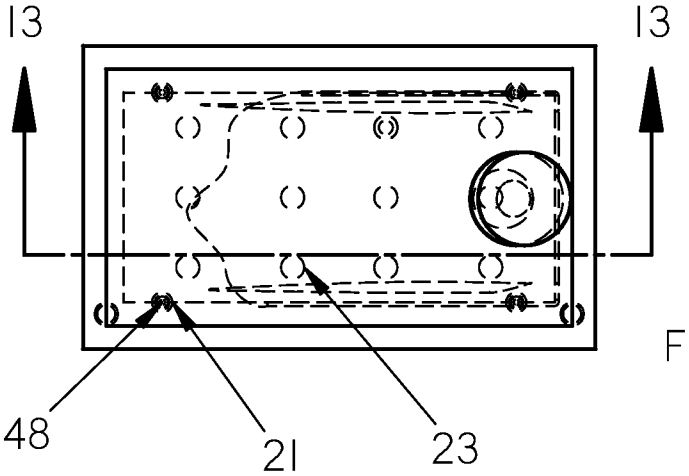
FIG. 14 is a top view illustrating the introduction of polyfoam liquid phase.

The liquid components L of polyfoam material are delivered into cavity as seen in FIG. 15 which allows the polyfoam material to expand about the rigid member 14 in a manner to enclose the rigid member 14 substantially within the polyfoam material with sufficient coverage to prevent delamination (e.g., an 1/8th inch preferred but deviations from this number are contemplated as providing a sufficient amount). To aid in accomplishing this, the rigid member 14 includes a predetermined number of openings 23 which are of a predetermined size and spatially positioned across the surface of the rigid member 14 in accordance with flow and expansion characteristics of the polyfoam material L.

Preferably, the polyfoam liquid is introduced onto the rigid member 14 as between in region 20 which forms the bottom surface 16 and is permitted to flow through the openings 23 into the remainder of the cavity 50 which forms an upper surface 18 of the sanding block 10. The method further includes disposing hook and loop member 24 adjacent the first mold part 30, i.e., surface 32, such that the polyfoam material can be introduced between the rigid member 14 and the hook and loop member 24 while the hook and loop member 24 is maintained in fixed position relative to the rigid member 14 during expansion and curing of the polyfoam material L. The sanding block 20 is formed via a molding process, in which two reactive liquid components, a polyol and an isocyanate, for example are metered, blended together, and introduced into a mold parts 30 and 40 at low pressure.

Here, the present invention is configured by inner block forming surface 52 configured for forming the sanding block 10. The there is operatively provided a feed mechanism 60 which can be a nozzle including liquid components, e.g., isocyanate and polyol, feed lines, a pump and return line and another liquid component, exchanger and nucleator.

The first forming surface 32 is configured with flat surface to receive the hook and loop member 24 thereagainst. The rigid member 14 and hook and loop member 24 are mechanically and adhered together. The hook and loop member 24 includes enough porosity to be securely bonded and the metal rigid member 14 is securely retained by enclosure from the polyfoam material.

Figure 16:
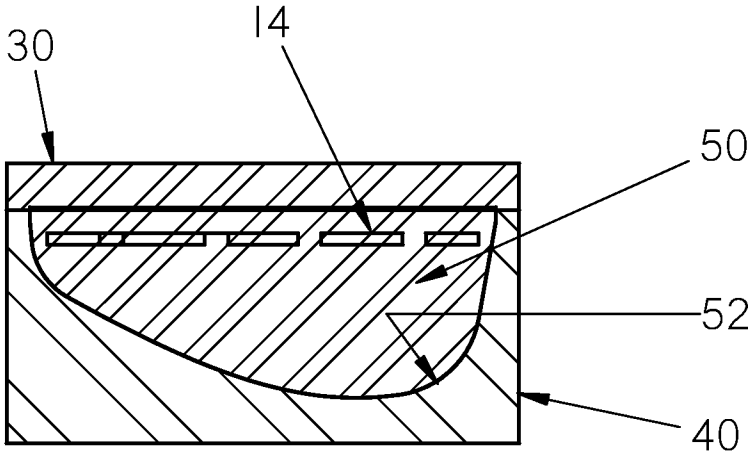
FIG. 16 is a cross section of illustration of parts and a curing step of a process of forming the sanding block of the invention.
Figure 8:
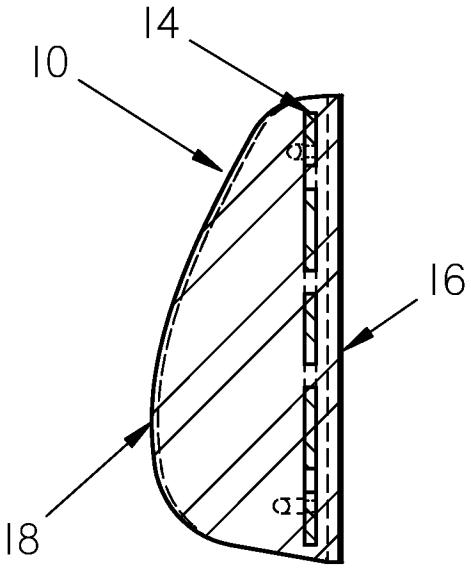
FIG. 8 is a cross sectional view of through line 8-8 of FIG. 7.
Figure 6:
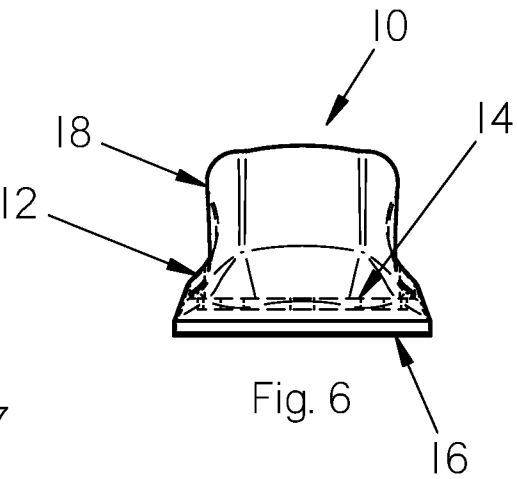
FIG. 6 is a back end view of the sanding block of the present invention.
Figure 10:
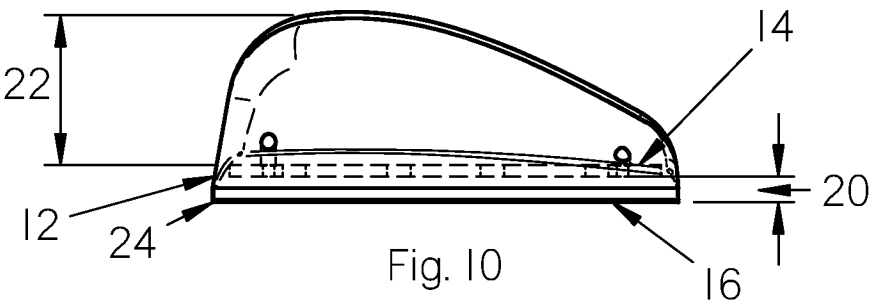
FIG. 10 is a side view illustrating hidden components of the of the sanding block of the present invention.
Figure 7:
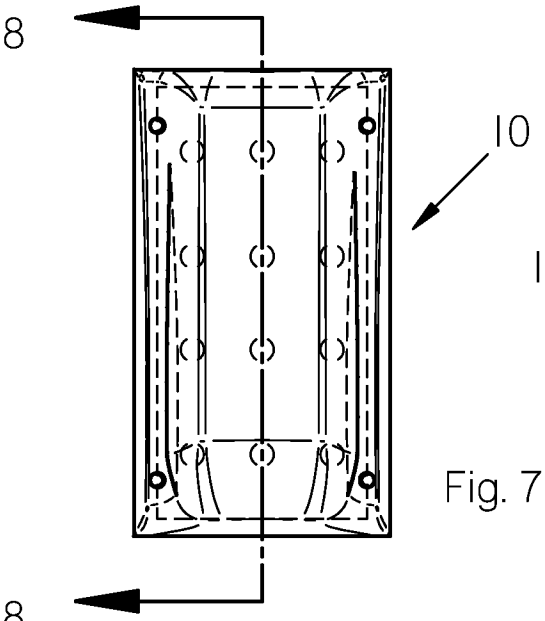
FIG. 7 is a top perspective view illustrating hidden components of the sanding block of the present invention.
Figure 9:
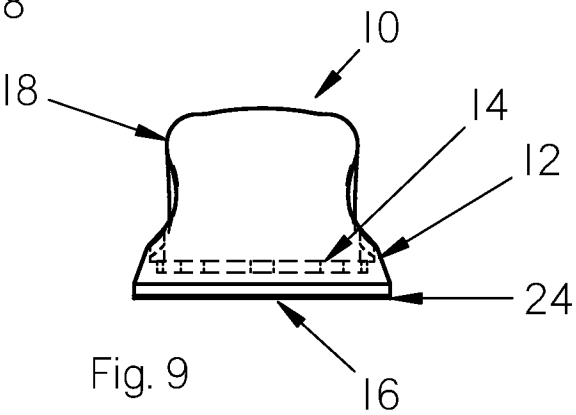
FIG. 9 is a front end view illustrating hidden components of the of the sanding block of the present invention.
Figure 17:
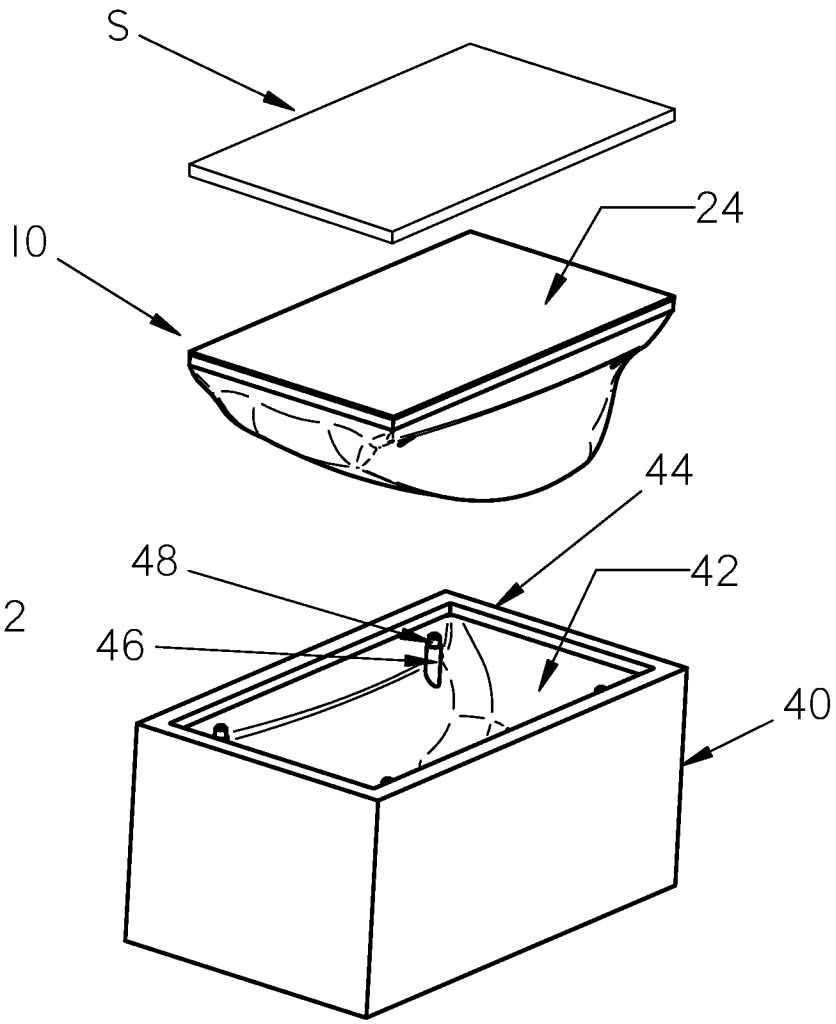
FIG. 17 is an illustration of parts and yet another step of a process of forming the sanding block of the invention.
Figure 12:
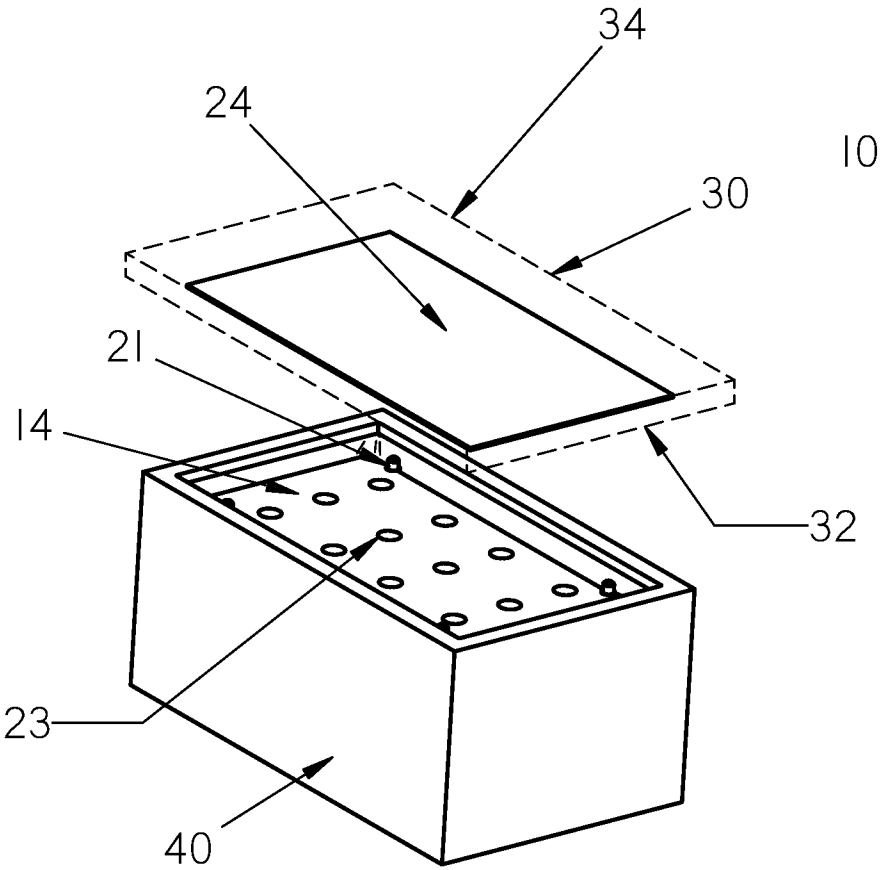
FIG. 12 is an illustration of parts and a step of a process of forming the sanding block of the invention.
Figure 13:
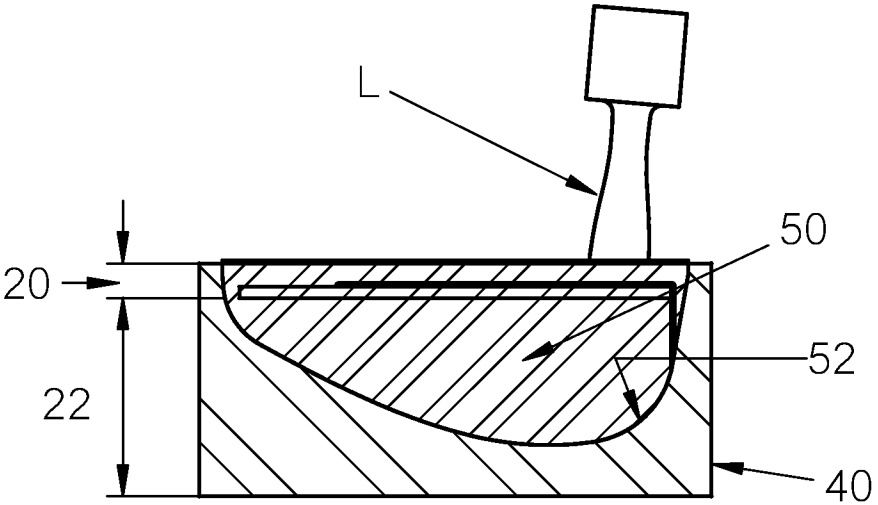
FIG. 13 is a cross section of FIG. 14 through line 13-13 which is an illustration of parts and another step of a process of forming the sanding block of the invention.

Once the rigid member 14 is in its respective position on the collars 48, the liquid L is supplied onto the rigid member 14 as seen in FIG. 15, for example. Due to the relatively short reaction time (10-15 seconds) the hook and loop portion 24 is disposed over the liquid as seen in FIGS. 13 and 16 and the mold part 30 secured.

The liquid material enters cavity 50 which forms the shape of the block 10. Upon a reaction between the components, the polyfoam layer is formed which is bonded to the rigid member 14 and hook and loop portion 24. The method of making the sanding block 10 can include amounts of the two components forming the polyfoam layer to aid in the control of a chemical reaction such that the components only permeate a portion of the hook and loop portion 24 through a surface facing the components as they react as well as sufficiently bond to and around the rigid member 14.

In a preferred embodiment, the liquids include a polyol and an isocyanate which can be metered, blended together, and introduced thereafter at low pressure to form the polyurethane structural foam. By introducing the liquid L onto the rigid member 14 in region 20, the foam part contacting within region 20 results in increased density compared to the remainder of cavity 50 which enters into cavity 50 through holes 23 and over edge of rigid member 14. This is preferred as the formed overall sanding block maintains a consistent rigid, flat and heavy bottom portion 12 while the upper portion 18 remains lighter, softer and user friendly. Subsequent the reaction, the block 10 is removed from the mold 40 and can be trimmed to provide a finished product.

After forming, an abrasive material, such as a sandpaper sheet S which can have of the hook and loop member (Velcro) on a backing thereof or simply be a sticky back sandpaper (in the case where hook and look material 24 is not desired in formation), can be fastened to the loop member to provide the sanding block 10. The sanding block 10 and method of making the same is exemplary of that contemplated by the inventor and it is contemplated that there can be a design changes to facilitate a particular use of the implement, such changes in shape. By so providing, the instant invention enables the manufacture of improved sanding block 10 which offer desirable qualities in ease of use, consistent finish and durability than previously available.

The above described embodiment is set forth to exemplify the invention and is in no way meant to limit the present invention. It will be readily apparent to those skilled in the art that various modifications, derivations and variations can be made to material and to structure without despairing from scope or essence of the invention. Accordingly, the appended claims should be read in their full scope including any such modifications, derivations and variations.

What is claimed is:

1. A foamed rigid bottom sanding block, which includes:

a sanding block formed of polyfoam material having a bottom portion with an integrally formed rigid member made of a material and thickness to lend weight as well as rigidity to said bottom portion, said rigid member nearly spanning a length and a width of said bottom portion and which encased within said polyfoam material, and an upper portion of said sanding block having a handle which protrudes from said bottom portion and is made of said polyfoam material.

2. The foamed rigid bottom sanding block of claim 1, wherein said rigid member is uniformly spaced from a bottom sanding surface of said sanding block.

3. The foamed rigid bottom sanding block of claim 2, wherein said rigid member is spaced up to about 0.25 inch from said bottom sanding surface to provide sufficient coverage and prevent delamination.

4. The foamed rigid bottom sanding block of claim 1, which includes a hook and loop member integrally connected to said bottom sanding surface by said polyfoam material.

5. The foamed rigid bottom sanding block of claim 1, wherein said polyfoam material between said rigid member and a bottom sanding surface of said sanding block is more dense than said polyfoam material in said handle.

6. The foamed rigid bottom sanding block of claim 1, wherein said handle is a shape symmetrically oriented along a longitudinal axis which generally aligns with a central axis of the block having a back end larger than a front end such that a downward slope exists from the back end to the front end.

7. The foamed rigid bottom sanding block of claim 1, wherein said rigid member is made of one of plastic, metal and wood.

8. The foamed rigid bottom sanding block of claim 1, wherein said rigid member is less than one quarter inch thick.

* * * * *